US005619770A

United States Patent [19]

Bell

[11] Patent Number: 5,619,770

[45] Date of Patent: Apr. 15, 1997

[54] ROTARY PAD HOLDER WITH QUICK-RELEASE MECHANISM

[75] Inventor: William E. Bell, Lawrenceville, Ga.

[73] Assignee: Flo-Pac Corporation, Minneapolis, Minn.

[21] Appl. No.: 562,475

[22] Filed: Nov. 24, 1995

[51] Int. Cl.[6] ..... A47L 11/14

[52] U.S. Cl. ..... 15/230.17; 15/230; 15/230.19; 15/98; 451/353; 451/508; 451/514

[58] Field of Search ..... 15/230, 230.12–230.19, 15/98; 451/353, 508, 514, 515, 518

[56] References Cited

U.S. PATENT DOCUMENTS

| | | | |
|---|---|---|---|
| 3,135,981 | 6/1964 | Fitch et al. | 15/230.19 X |
| 3,183,542 | 5/1965 | Anders | 15/246 |
| 3,401,416 | 9/1968 | Ziegler | 15/49.1 |
| 3,513,875 | 5/1970 | Nelson . | |
| 3,561,035 | 2/1971 | Leonforte | 15/230.19 |
| 3,562,843 | 2/1971 | Belicka | 15/180 |
| 3,757,378 | 9/1973 | Wakefield | 15/230.19 |
| 4,365,377 | 12/1982 | Todd et al. | 15/98 |
| 4,541,107 | 9/1985 | Antonson . | |
| 4,662,024 | 5/1987 | Moench | 15/230.19 |
| 4,720,883 | 1/1988 | Sanchez | 15/4 |
| 4,763,373 | 8/1988 | Sanchez | 15/29 |
| 4,826,379 | 5/1989 | Norden . | |
| 4,856,133 | 8/1989 | Sanchez | 15/29 |
| 4,866,804 | 9/1989 | Masbruch et al. | 15/49.1 |
| 4,888,843 | 12/1989 | Smith et al. | 15/98 |
| 5,259,085 | 11/1993 | Marafante et al. | 15/98 |
| 5,400,461 | 3/1995 | Malish et al. | 15/230.17 |

FOREIGN PATENT DOCUMENTS

| | | | |
|---|---|---|---|
| 506319 | 4/1957 | Italy | 451/353 |

*Primary Examiner*—Mark Spisich
*Attorney, Agent, or Firm*—Christensen O'Connor Johnson & Kindness PLLC

[57] ABSTRACT

An apparatus for holding a pad to a rotary pad machine. The apparatus includes a base piece and a retainer piece. The base piece includes a plurality of base teeth and is attached to a pad driver disc of the rotary pad machine. The retainer piece includes quick-release tabs having locking ribs. When the retainer piece is inserted into the base piece, the locking ribs lock into the base teeth to hold the retainer piece to the base piece. Flanges on the base piece and the retainer piece hold the pad therebetween. To tighten the rotary pad holder, the retainer piece is pressed closer to the base piece until the locking ribs lock into the appropriate base teeth. To loosen the rotary pad holder or change pads, the quick-release tabs are pressed in towards each other which unlocks the locking ribs from the base teeth and the retainer piece can be removed from the base piece. The rotary pad holder does not over tighten or over loosen because any torque applied to the pad holder is resisted by the retainer wall edges hitting against the connecting walls of the base piece.

15 Claims, 5 Drawing Sheets

ROTARY PAD HOLDER WITH QUICK-RELEASE MECHANISM

FIELD OF THE INVENTION

The present invention relates to rotary pad machines or floor maintenance machines, and in particular relates to an apparatus particularly designed to secure a floor maintenance pad to a rotary pad machine.

BACKGROUND OF THE INVENTION

Rotary pad machines, or floor maintenance machines, are fast and efficient for performing a variety of tasks. Rotary pad machines can be used for buffing, scrubbing, burnishing, polishing and other floor maintenance applications. Usually, a rotary pad machine has a drive shaft that rotates a pad driver disc. Attached to the pad driver disc is a pad used to clean or maintain the floor. A rotary pad holder holds the pad to the pad driver disc.

Rotary pad holders are well-known for centering and holding a floor maintenance pad to a pad driver disc of a rotary pad machine. Typically, these rotary pad holders have two pieces with mating threads. The first piece is fixed to the pad driver disc, and the second piece is threaded to the first piece to hold the pad between the first and second pieces in a centered position on the pad driver disc. The second piece is uncoupled by unthreading to replace the pad.

When using a rotary pad machine, the operator will frequently have to replace pads due to wear or to use a pad with different abrasive characteristics. Often, the operator of a rotary pad machine will not be equipped with tools to change the pads. For a number of pad holders, no tools are needed because the second piece can be unthreaded from the first piece by turning the second piece by hand. However, unthreading the second piece of the rotary pad holder from the first piece can be time-consuming. In addition, the operator of a rotary pad machine may have to make frequent adjustments to the pad holder because a pad is slipping or not being correctly held in place by the rotary pad holder. Because of frequent changes and adjustment of pads, there is a need for a pad holder with a quick release mechanism so that pads can be changed or adjusted, quickly and easily, without the use of tools and without requiting unthreading.

As mentioned above, unthreading a pad holder device can be time-consuming. However, the threaded connection in pad holder devices can result in other problems as well. For example, the threading is usually left-handed or right-handed depending on the direction of rotation of the pad driver disc. The thread direction is chosen such that the resultant torque on the pad holder, when the rotary pad machine is in use, tends to tighten the threaded connection. Therefore, operation of the rotary machine tends to hold the pad in place rather than unthreading and releasing the pad. However, the torque can often tighten the rotary pad holder so much that it is extremely difficult to remove when the operator wants to change floor pads. Furthermore, as disclosed in Malish, U.S. Pat. No. 5,400,461, rotary pad holders sometimes loosen during floor maintenance operations. Thus, there is a need for a rotary pad holder that will neither loosen nor tighten during operation of the rotary pad machine.

Some rotary pad machines have two pad driver discs rotating in opposite directions. For these machines, it is necessary to use one left-handed threaded pad holder and one right-handed threaded pad holder. The right-handed threaded pieces and left-handed threaded pieces of the pad holders are not interchangeable. Thus, for spare pans and supply purposes, it is necessary to keep both right-handed threaded and left-handed threaded pieces in stock. In addition, for manufacturing purposes, it is necessary to have equipment to manufacture both left-handed threaded pieces and right-handed threaded pieces. There is a need for a rotary pad holder that uses the same pans for clockwise-rotating pad driver discs and counter-clockwise-rotating pad driver discs.

There are at present a wide range of floor maintenance pads available for use on rotary pad machines. These pads must be of different materials, abrasiveness, and structure to perform the many functions required of floor maintenance machines such as buffing, scrubbing, and polishing. Furthermore, these pads are of varying thicknesses. Thus, there is a need for a rotary pad holder that can be adjusted, quickly and easily, to accommodate pads of varying thicknesses.

Smith, U.S. Pat. No. 4,888,843, describes a rotary pad holder in which a top piece of the pad holder includes internal, continuous threads which are engaged by matching threads, or portions of threads, on a bottom insert. The bottom insert is pressed into place on the top piece, and the insert may be rotated to tighten the pad into place or to remove the insert so the pad may be replaced. While the Smith pad holder accommodates pad of different thicknesses, the two pieces described by Smith can rotate relative to one another. Thus, the problem of over tightening and over loosening is not solved. Also, the Smith patent does not teach a quick release mechanism because the bottom piece in Smith must be unthreaded from the top piece to change pads.

Malish, U.S. Pat. No. 5,400,461, describes a rotary pad holder which is threaded into place and includes detents which pop out and match into indentations in the lower piece when the two halves are screwed together. The detents prevent over tightening of the pad and lock the pad into place. However, the detents in the pad holder produced in accordance with the patent have been known to release as a result of the torque applied by the rotary pad machine and over tightening is not always avoided. Moreover, the rotary pad holder described in Malish is difficult to disconnect because it requires the lower piece to be unthreaded from the upper piece in a similar fashion to the rotary pad holder described by Smith.

Thus, the prior art shows a need for a rotary pad holder which holds and centers a pad to a rotary pad machine and has a quick release mechanism for changing pads. The prior art also shows a need for a rotary pad holder which accommodates pads of different thicknesses and does not require tools for changing the pads. The prior art further shows a need for a rotary pad holder which has consistent parts independent of the rotational direction of the pad driver disc and neither loosens nor tightens during use. The needs outlined above led to the present invention.

SUMMARY OF THE PRESENT INVENTION

The present invention provides a rotary pad holder for a rotary pad machine or floor maintenance machine. The basic functioning of the present invention is as follows. A base piece of the rotary pad holder of the present invention is mounted to a pad driver disc of a rotary pad machine. A floor maintenance pad, usually shaped like a large washer, is placed onto the base piece. A retainer piece of the rotary pad holder of the present invention is aligned with the base piece, and is pressed into the base piece until it locks into the base piece at the appropriate level for the thickness of the pad. The inner circumference of the floor maintenance pad is held between the base piece and the retainer piece. The rotary pad machine rotates the pad driver disc and the pad so the pad can clean or maintain the floor.

Generally described, the rotary pad holder of the present invention has a base piece and a retainer piece. The base piece has a base wall and a base flange. The base flange extends radially outward from the base wall. The base piece has a plurality of base teeth on the base wall. The retainer piece has retainer walls and a retainer flange. The retainer flange extends radially outward from the retainer walls. The retainer walls are designed to fit inside the base wall. There are a plurality of locking ribs attached to the retainer walls. The locking ribs lock into the base teeth when the retainer piece is inserted into the base piece. The present invention also includes a plurality of quick-release tabs connected to the locking ribs to allow the retainer piece to be removed from the base piece by releasing the locking ribs from the base teeth.

More particularly described, an embodiment of the rotary pad holder of the present invention has an upper piece called a base piece. The base piece has a base wall that is essentially cylindrically-shaped except for two indentations called base arcuate segments. The base arcuate segments are attached to the cylindrical portion of the base wall by connecting walls. On the inner surface of the base arcuate segments are a plurality of base teeth, preferably with a sawtooth cross-sectional profile.

Extending radially from the base piece is a base flange. The base flange includes a plurality of mounting holes for mounting the base piece to a pad driver disc. The base flange also includes a plurality of conical teeth. By digging into the pad, the conical teeth hold the pad in place and keep the pad from rotating with respect to the base piece.

The lower piece of the present invention is called the retainer piece. The retainer piece has retainer walls that are shaped like half-cylinders. The retainer walls end in retainer wall edges. Extending radially from the bottom of the retainer walls is a washer-shaped retainer flange. On top of the retainer flange are a plurality of conical teeth for holding the pad in place.

A retainer connecting piece is attached to each retainer wall edge and extends in toward the center of the retainer piece. A plurality of quick-release tabs are connected between the retainer connecting pieces. The quick-release tabs extend down toward the bottom of the retainer piece, then in toward the center of the retainer piece before finally extending down again.

On the outer surface of each quick-release tab is a locking rib. Preferably, each locking rib has a sawtooth cross-sectional profile. The locking ribs lock into the base teeth to hold the retainer piece to the base piece. The lower end of the quick release tabs are of sufficient thickness to bias the quick release tabs outward against the base teeth, but sufficiently thin so that the quick release tabs may be pressed inward by a user to release the locking ribs from the base teeth. The locking ribs and base teeth are designed such that the retainer piece can be moved closer to the base piece simply by pressing the retainer piece into the base piece. However, the design of the base teeth and locking ribs also is such that it is impossible to move the retainer piece away from the base piece unless the quick-release tabs are pressed in toward each other.

An inventive contribution of the present invention is the quick-release tabs. Because of the quick-release tabs, no tools are required to change or adjust pads. By pressing the quick-release tabs, the locking ribs and base teeth are freed from each other and the retainer piece can be moved away from the base piece. Thus, without requiting tools, the retainer piece can quickly and easily be separated from the base piece. No unthreading is required. This is one way of providing the quick release mechanism of the present invention.

Another inventive contribution of the present invention are the locking ribs and the base teeth. Because of the locking ribs and base teeth, the present invention can accommodate pads of varying thicknesses. For example, by pressing on the retainer piece, it can be moved closer to the base piece until the locking ribs and base teeth lock and the pad is held securely in place. Because there are a plurality of base teeth along the inner surface of the base arcuate segment, the retainer piece can be pressed until the locking ribs lock into the base teeth corresponding to the appropriate pad thickness.

Another inventive contribution of the present invention is that it can be used whether the pad driver disc rotates clockwise or counter-clockwise. Because the present invention does not have continuous threads, there is no need to adjust the rotary pad holder depending on the rotation of the pad driver disc. Thus, part supplies and manufacturing costs are reduced.

Also, the present invention neither loosens nor tightens when the rotary pad machine is in use. When the pad driver disc's rotation causes a torque which might tighten or loosen the rotary pad holder, the base connecting wall and the retainer wall edge engage each other and prevent the retainer piece from rotating relative to the base piece.

The present invention is designed to overcome the problems and disadvantages of the prior art. The present invention has a quick release mechanism so that the operator of the rotary pad machine can quickly and easily change pads or adjust the pad holder to accommodate different pad thicknesses. The present invention does not require tools to change the pads. In addition, the present invention neither loosens nor tightens during operation of the rotary pad machine.

Therefore, it is an object of the present invention to provide an apparatus that holds and centers a pad to a rotary pad machine.

It is a further object to provide such an apparatus that will connect and disconnect, dependably and quickly, so the pad can be adjusted or changed.

It is a further object of the present invention to provide such an apparatus that can accommodate pads of varying thicknesses.

It is still a further object of the present invention to provide such an apparatus so that pads can be changed or adjusted without requiting the use of tools.

It is still a further object of the present invention to provide such an apparatus with consistent pans independent of the rotational direction of the pad driver disc.

It is still a further object of the present invention to provide such an apparatus that neither loosens nor tightens during operation of the rotary pad machine.

Other features and advantages of the present invention will be apparent to persons skilled in the art from the following detailed description of a preferred embodiment accompanied by the attached drawings wherein identical reference numerals will refer to like pans in the various views.

BRIEF DESCRIPTION OF THE DRAWINGS

FIG. 5 is a perspective view of the rotary pad holder of FIG. 1, with the quick release mechanism shown in phantom to show detail and with the base and retainer pieces snapped into position as if a pad were held in place there between.

FIG. 6 is a perspective view of the rotary pad holder of FIG. 1, with the base and retainer pieces snapped into position as if a pad were held in place there between.

DETAILED DESCRIPTION

The present invention is a rotary pad holder for a rotary pad machine. Rotary pad machines can be used for buffing, scrubbing, burnishing, polishing and other cleaning and maintenance applications. Such a rotary pad machine is disclosed in U.S. Pat. No. 4,888,843, incorporated herein by reference. These rotary pad machines typically include a pad driver disc rotated by a drive shaft. A typical rotary pad holder includes two pieces with mating threads. The first piece is attached to the pad driver disc and the second piece is threaded on the first piece to hold the pad in a centered position on the pad driver disc. The present invention is an improvement upon the typical rotary pad holder.

Figure 1:
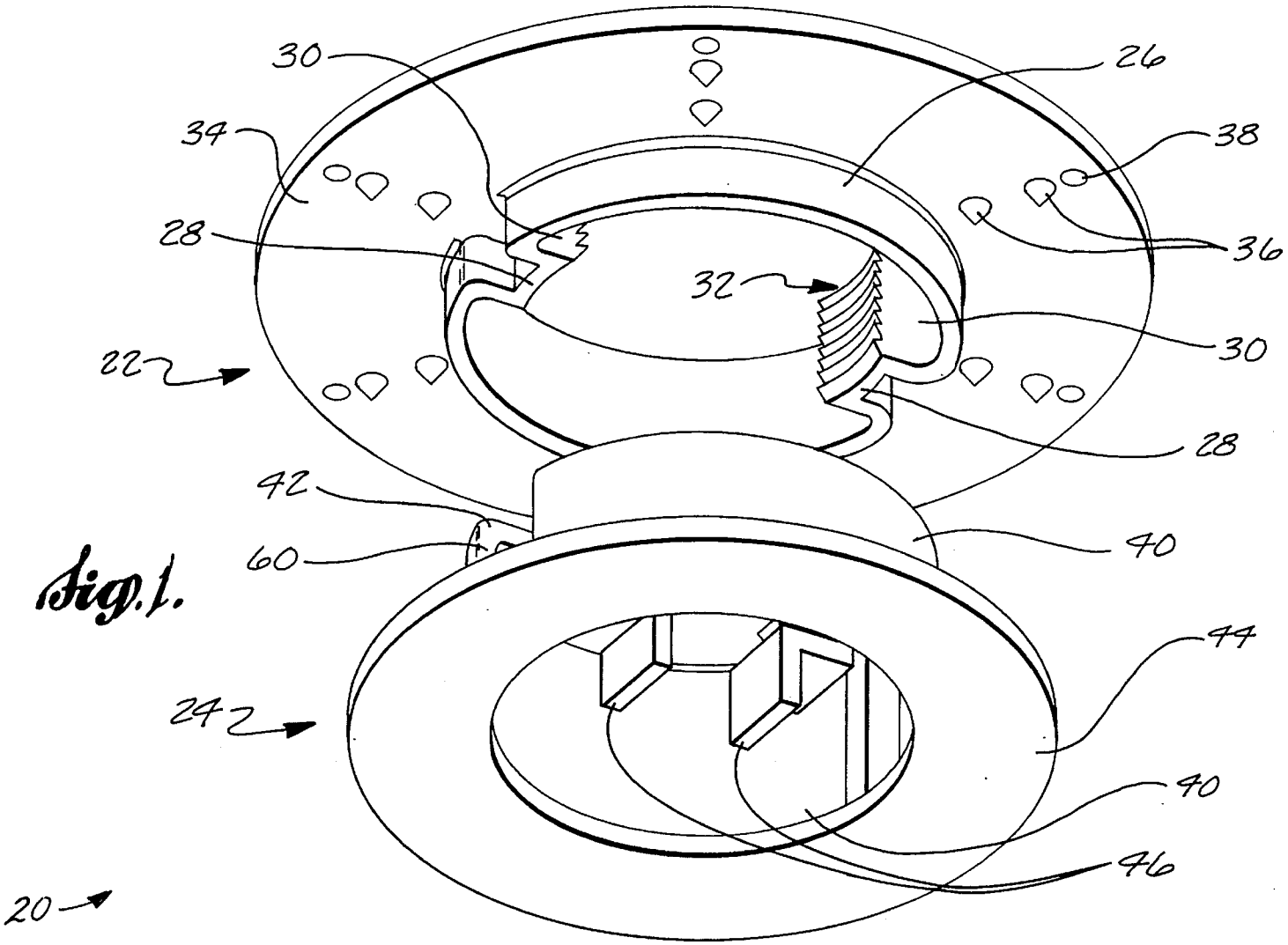
FIG. 1 is a perspective view of a preferred embodiment of the pad holder of the present invention.

As shown in FIG. 1, a preferred embodiment of a rotary pad holder in accordance with the present invention is designated generally by the reference numeral 20. As shown, the rotary pad holder 20 includes two interlocking pieces, a base piece 22 and a retainer piece 24. The base piece 22 includes a base flange 34 and base teeth 32. The retainer piece 24 includes a retainer flange 44 and locking ribs 48 shown in FIG. 2.

The rotary pad holder 20 functions as follows. The base piece 22 is attached to a pad driver disc of a rotary pad machine (not shown, but known in the art). A pad (not shown) is placed onto the base flange 34 of base piece 22. The retainer piece 24 is pressed into the base piece 22 until the locking ribs 48 and base teeth 32 lock together such that the pad is centered and held in place between the base flange 34 and the retainer flange 44. The rotary pad machine rotates a drive shaft which rotates the pad driver disc which, in turn, rotates the rotary pad holder 20 and the pad. The spinning pad can be used for cleaning or maintenance purposes.

The present invention also includes two quick-release tabs 46. The lower end of the quick release tabs 46 are of sufficient thickness to bias the quick release tabs outward against the base teeth 32, but sufficiently thin so that the quick release tabs 46 may be pressed inward by a user to release the locking ribs 48 from the base teeth 32. When a pad needs to be changed or adjusted, the operator of the rotary pad machine can press the quick-release tabs 46 in toward each other which releases the retainer piece 24 from the base piece 22. The retainer piece 24 can be moved away from the base piece 22 to loosen the grip of the rotary pad holder 20 on the pad or to change pads. When the rotary pad holder 20 needs to be tightened, the retainer piece 24 is pressed into the base piece 22 until the desired pressure on the pad is achieved. To tighten the present invention, the retainer piece 24 is aligned with the base piece 22 and the retainer piece is pressed toward the base piece. The quick-release tabs 46 do not need to be pressed inward to tighten the present invention.

More particularly described, the base piece 22 includes a base wall 26 that is arranged such that when the rotary pad holder is mounted on a rotary pad machine, the base wall 26 is coaxial to a drive shaft of the rotary pad machine (not shown). The shape of the base wall 26 is cylindrical, except for two base arcuate segments 28. The two base arcuate segments 28 are connected to the cylindrical portion of the base wall 26 by connecting walls 30. It should be noted that although the base wall 26 is preferably almost cylindrical, the base walls could be another shape, with an opening in the middle.

The base arcuate segments 28 are arced and the same height as the rest of the base wall 26. However, the base arcuate segments 28 have a smaller radius than the base walls 26. Although the base arcuate segments 28 are preferably arced, the base arcuate segments also could be straight. On the inside surface of the base arcuate segments 28 are a plurality of base teeth 32.

Figure 2:
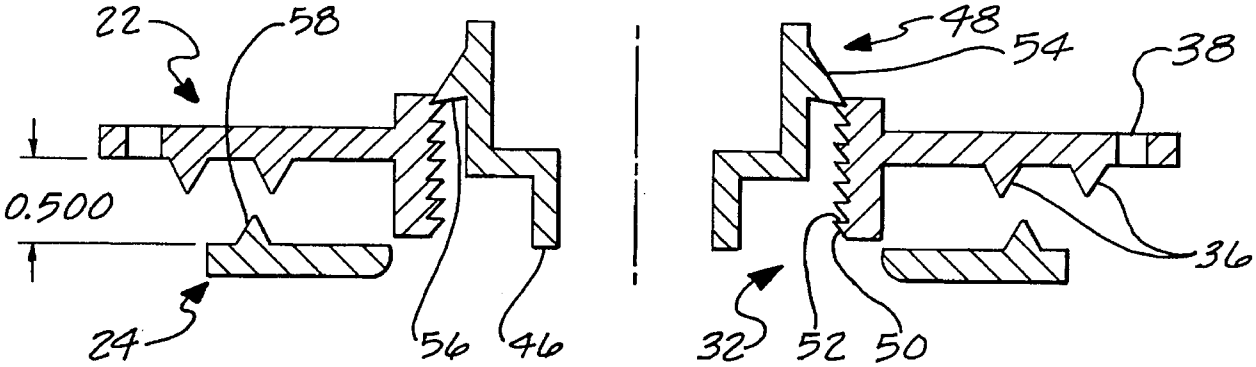
FIG. 2 is a side cross-sectional view of the base piece, the finger tabs and the retainer flange of the pad holder of FIG. 6, taken along the section line 2—2 of FIG. 6.

In the preferred embodiment, the base teeth 32 have a sawtooth cross-sectional configuration as shown by the side cross-sectional view of FIG. 2. Each base tooth 32 has an insertion surface 50 that is slanted upwards in the direction of the insertion of the retainer piece 24. Each base tooth 32 also has a holding surface 52 that prevents the retainer piece 24 from moving away from the base piece 22 when the two pieces are connected. The holding surface 52 is slightly slanted in the direction of the removal of the retainer piece 24.

The base arcuate segments 28 are connected to the cylindrical portion of the base wall 26 by connecting walls 30. As shown in FIG. 1, the connecting walls 30 connect the outer surface of the base arcuate segments 28 to the inner surface of the base wall 26. The surfaces of the connecting walls 30 are preferably smooth. The height of the connecting walls 30 is preferably the same as the cylindrical portion of the base wall 26. The function of the connecting walls 30 will be more fully described below in the discussion of the retainer piece 24.

A base flange 34 extends radially from the base wall 26 and the base arcuate segments 28. In the preferred embodiment, the base wall 26, the base arcuate segments 28, and the connecting walls 30 project both above and below the base flange 34.

A plurality of conical teeth 36 project down from the bottom surface of the base flange 34. The conical teeth 36 press into the pad to help hold the pad in place when the rotary pad machine is in use. As shown in FIG. 2, the conical teeth 36 have a triangular cross-section. Although the alignment of the teeth and number of the teeth can vary, in the preferred embodiment the conical teeth 36 are aligned with two conical teeth along each of six straight lines extending radially from the base wall 26. The base flange 34 may also contain mounting holes 38 to mount or fasten the base piece 22 to the pad driver disc. In the preferred embodiment, the mounting holes 38 are aligned along the same lines as the conical teeth 36.

The lower piece of the rotary pad holder 20 is the retainer piece 24. The retainer piece 24 connects into the base piece 22 to hold a pad in place. The retainer piece 24 has two retainer walls 40 that are shaped like half-cylinders. The retainer walls 40 end in retainer wall edges 60. The retainer walls 40 are designed at a slightly smaller radius than the base wall 26 so that the retainer piece 24 can easily be inserted into the base piece 22. The design is such that the retainer wall edge 60 rests against the connecting walls 30 when the retainer piece 24 is connected to the base piece 22.

Extending radially from the bottom of the retainer walls 40 is a washer-shaped retainer flange 44. As shown in cross-section in FIG. 2, conical teeth 58 extend upward from the top of the retainer flange 44. When the retainer piece 24 and base piece 22 are connected, the retainer flange 44 presses the inner circumference of a pad onto the conical teeth 36 of the base piece 22 and the conical teeth 58 of the retainer piece 24. The conical teeth 36, 58, and pressure from the retainer flange 44 and base flange 34 hold the pad in place while the rotary pad machine is in use.

At the top edge of each retainer wall 40 are retainer connecting pieces 42 that extend from the top of each retainer wall edge 60 toward the center of the retainer piece 24. The retainer connecting pieces 42 can best be seen in FIG. 4.

In the preferred embodiment, two quick-release tabs 46 are connected between the retainer connecting pieces 42. The quick-release tabs 46 extend down in the direction of removal of the retainer piece 24, then in toward the center of the retainer piece 24 before finally extending down again. The lower end of the quick release tabs 46 are of sufficient thickness to bias the quick release tabs outward against the base teeth 32, but sufficiently thin so that the quick release tabs 46 may be pressed inward by a user to release the locking ribs 48 from the base teeth 32.

A locking rib 48 is located on the outside of each quick-release tab 46. As shown in FIG. 2, each locking rib 48 has a glide surface 54 and a stop surface 56. In the preferred embodiment, the locking rib 48 has a sawtooth cross-sectional configuration. The glide surface 54 of each locking rib is at a similar angle as the insertion surface 50 of the base teeth. Thus, the glide surface 54 slides along the insertion surface 50 when the retainer piece 24 is moved toward the base piece 22. After the retainer piece 24 is inserted into the base piece 22, the base teeth 32 and the locking ribs 48 lock together. The stop surface 56 is slanted at an angle similar to the angle of the holding surface 52. The force between the holding surface 52 and the stop surface 56 prevents the retainer piece 24 from moving away from the base piece 22.

In the preferred embodiment of the rotary pad holder 20, each of the quick release tabs 46 are cast as one piece of plastic with the rotary pad holder. The lower end of the quick release tabs 46 are of sufficient thickness to bias the quick release tabs outward against the base teeth 32, but sufficiently thin so that the quick release tabs 46 may be pressed inward by a user to release the locking ribs 48 from the base teeth 32.

Once the base teeth 32 and locking ribs 48 lock together, the retainer piece 24 can not be moved away from the base piece 22 unless the quick-release tabs 46 are pressed inward which releases the stop surface 56 from the holding surface 52. However, the retainer piece 24 can still be moved towards the base piece 22 to tighten the pad.

The present invention does not suffer from the problems of over tightening or over loosening encountered by the prior art because of the arrangement of the base connecting wall 30 and the retainer wall edge 60, shown in FIG. 1. When the retainer piece 24 is inserted into the base piece 22, the retainer wall edges 60 are nearly flush with the base connecting walls 30. The rotation of the rotary pad machine will not cause over tightening or over loosening of the pad because any rotation of the retainer piece 24 relative to the base piece 22 will be resisted by the retainer wall edges 60 pressing against the base connecting walls 30. Unlike rotary pad holders with threads, the present invention does not loosen or tighten by rotating the retainer piece 24 relative to the base piece 22. The only way to loosen the rotary pad holder 20 of the present invention is to press on the quick-release tabs 46 causing the locking ribs 48 to disengage the base teeth 32. The rotary pad holder 20 of the present invention can be tightened by pressing the retainer piece 24 closer to the base piece 22.

Figure 3:
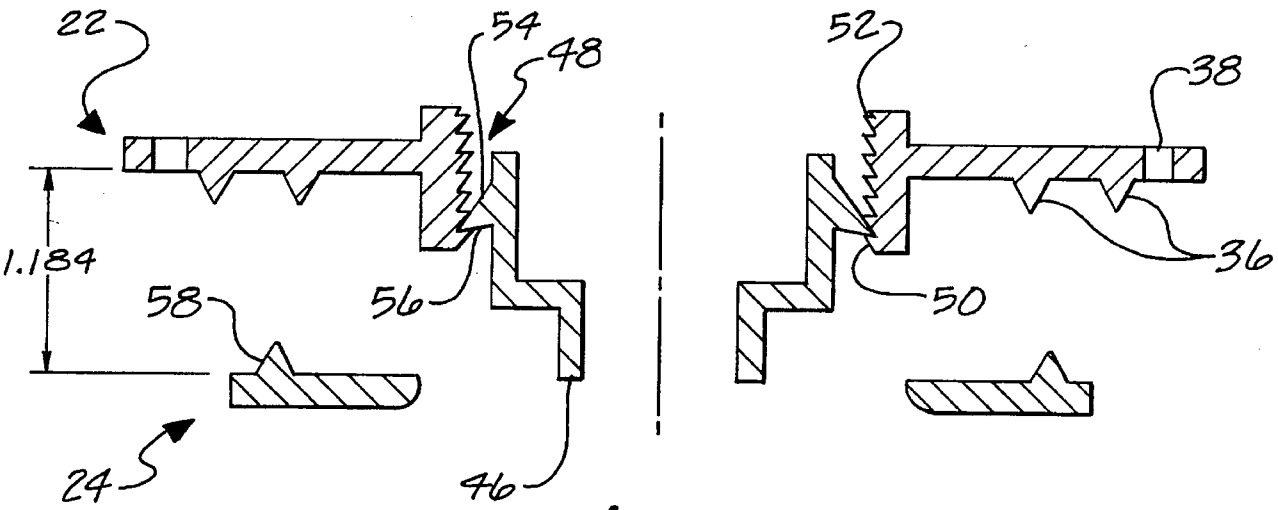
FIG. 3 is another cross-sectional view of the base piece of the pad holder of FIG. 6 taken along the section line 2—2 of FIG. 6, the finger tabs and the retainer flange showing that the present invention can accommodate pads of varying thicknesses.

The present invention can accommodate pads of varying thicknesses as shown in FIGS. 2–3. For instance, FIG. 2 shows a cross-section of pan of the rotary pad holder in a maximum closed position. The locking ribs 48 are locked into the highest base teeth 32 possible. The base piece 22 and the retainer piece 24 are as close together as possible. In the preferred embodiment, the base piece would be 0.5 inches from the retainer piece when the rotary pad holder 20 is in the maximum closed position.

FIG. 3 shows a cross-section of part of the rotary pad holder 20 in the maximum open position. The retainer piece 24 is as far apart from the base piece 22 as possible while still being connected together. The locking ribs 48 are locked into the lowest base teeth 32 possible. In the preferred embodiment, the base piece 22 would be 1.154 inches from the retainer piece 24 when the rotary pad holder 20 is in the maximum open position.

It should be noted that the locking ribs 48 of the rotary pad holder can be locked into any of the base teeth 32. The operator of the rotary pad machine will decide what base teeth 32 to lock the locking ribs 48 into based on the thickness of the pad and how tight the pad needs to be held.

It should be noted that to move the rotary pad holder from the position in FIG. 2 to the position in FIG. 3 requires the quick-release tabs 46 to be pressed in toward each other to release the locking ribs 48 from the base teeth 32. While holding the quick-release tabs in, the retainer piece 24 can then be moved away from the base piece 22 until the desired base teeth 32 are reached. To change pads, the quick-release tabs 46 are pressed in and held while the retainer piece 24 is separated from the base piece 22.

It should be noted that to move the rotary pad holder from the position in FIG. 3 to the position in FIG. 2 does not require the quick-release tabs 46 to be pressed in toward each other to release the locking ribs 48 from the base teeth 32. The retainer piece 24 is pressed toward the base piece 22 and the locking ribs 48 ratchet over the base teeth 32 until the desired base teeth 32 are reached.

Figure 4:
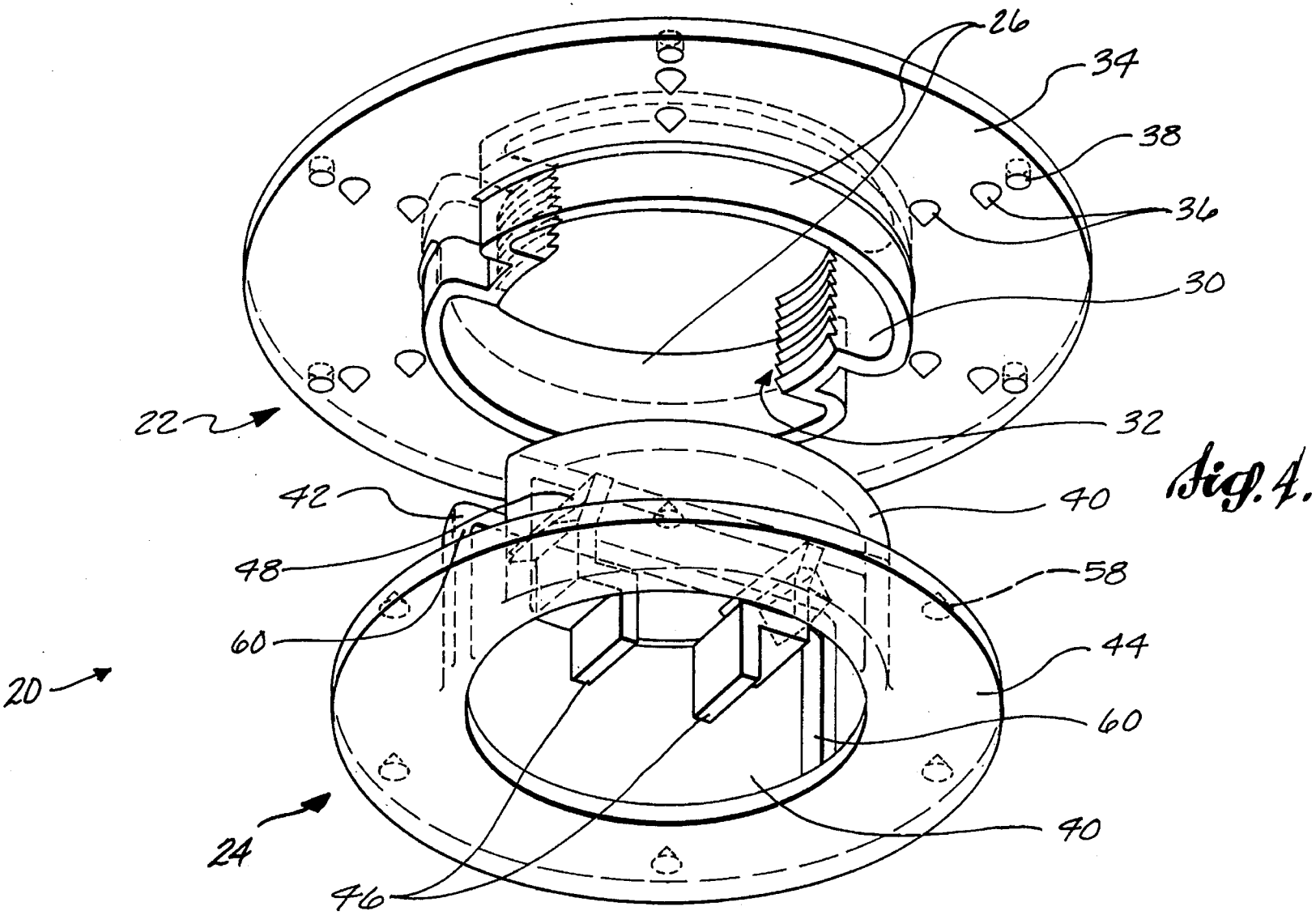
FIG. 4 is a perspective view of the rotary pad holder of FIG. 1, with the quick release mechanism shown in phantom to show detail.
Figure 5:
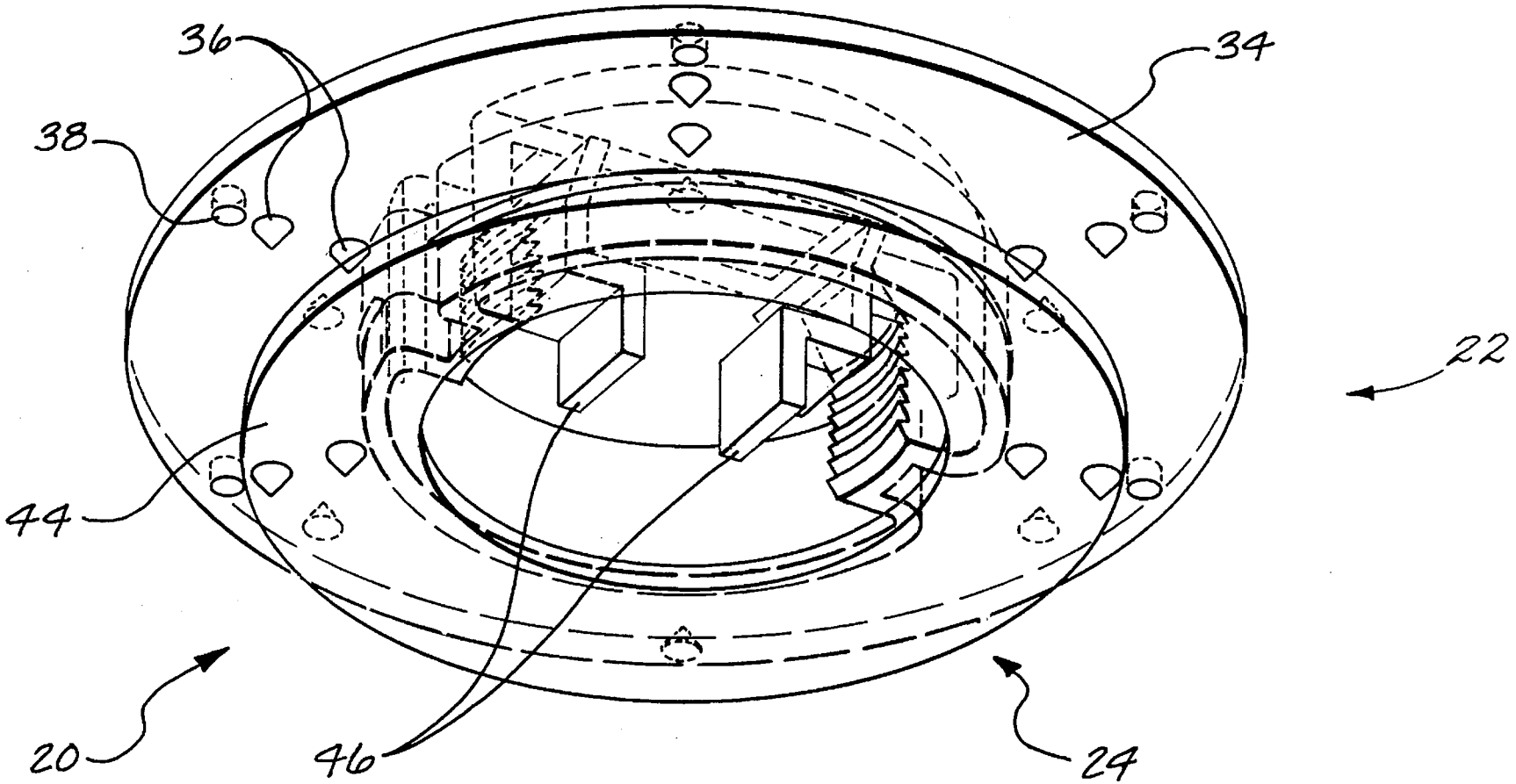
Figure 6:
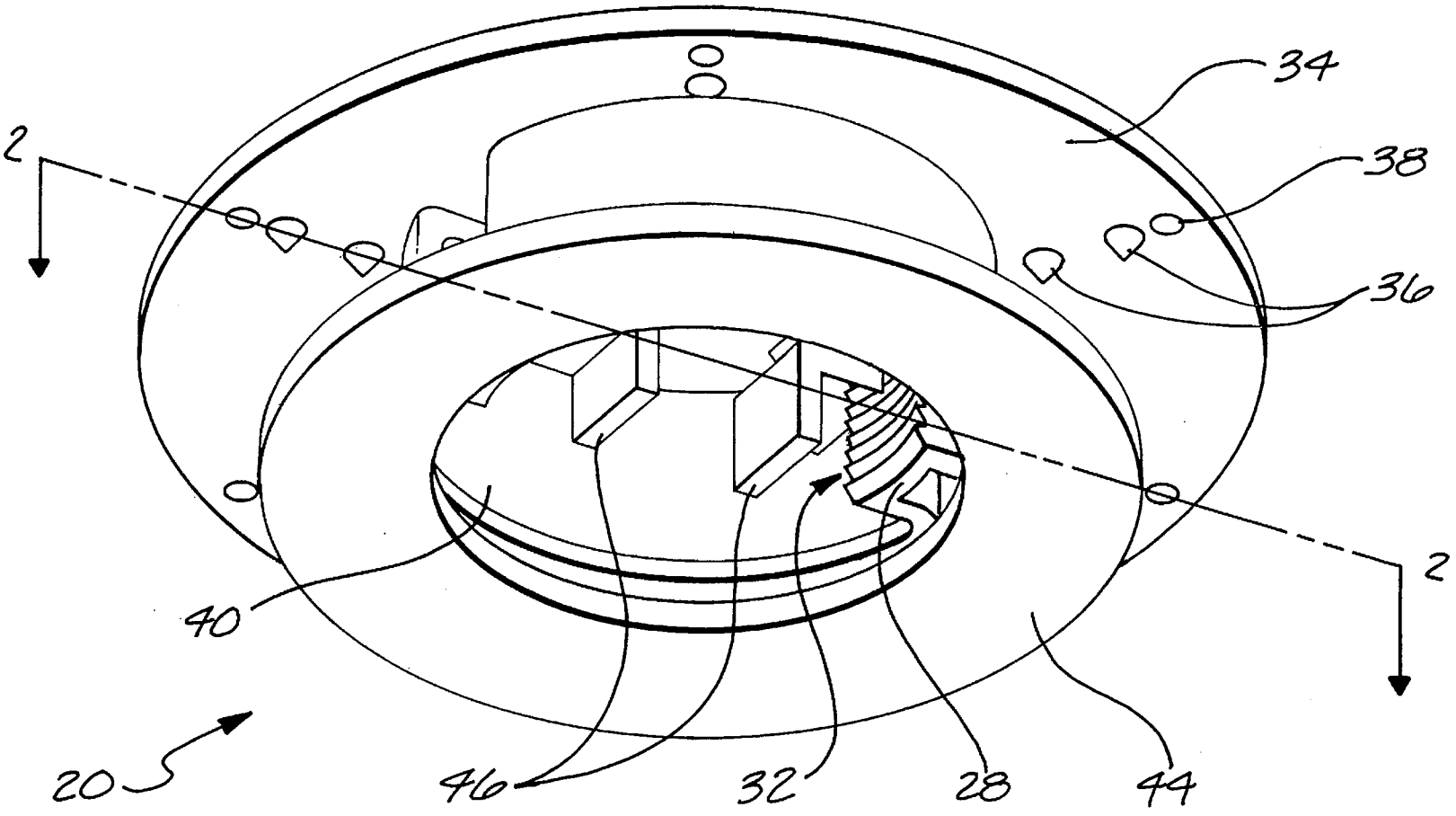

FIG. 4 is a cut-away side-elevational view of the preferred embodiment of the present invention. It should be noted that FIG. 4 shows the rotary pad holder 20 with the base piece 22 and the retainer piece 24 not connected. FIG. 5 is a cut-away side elevational view of a preferred embodiment of the present invention. FIG. 6 is a side elevational view of a preferred embodiment of the present invention. The rotary pad holder 20 shown in FIGS. 5–6 is in the maximum closed position.

In the preferred embodiment of the present invention, the rotary pad holder is molded as two pieces. However, it should be apparent that the claims encompass other techniques of making the present invention.

Given the foregoing disclosure of the preferred embodiment and design parameters for the present invention, other embodiments of the present invention will suggest themselves to those skilled in the art. Therefore, the scope of the present invention is to be limited only by the claims below.

What is claimed is:

1. An apparatus for mounting a pad to a rotary pad machine comprising:

a base piece having a base wall and a base flange extending radially outward from said base wall;

a plurality of base teeth on said base wall;

a retainer piece comprising a retainer wall, said retainer wall adapted to be received in said base wall;

a retainer flange extending radially outward from said retainer wall;

a locking rib attached to said retainer wall, said locking rib adapted to lock with said base teeth; and a quick-release tab attached to said locking rib, said quick-release tab adapted to release said locking rib from said base teeth;

said retainer piece and said base piece configured such that when said retainer wall is received in said base wall, said pad is located and held between said base flange and said retainer flange.

2. The apparatus of claim 1, further comprising means for biasing said locking rib against said base teeth.

3. The apparatus of claim 2, wherein said means for biasing comprises the quick-release tab being integrally molded with said retainer wall, and said quick-release tab comprising a resilient material.

4. The apparatus of claim 1 wherein said base teeth and said locking rib have a saw-tooth configuration.

5. The apparatus of claim 1 further comprising another quick-release tab and attached locking rib and wherein said quick-release tabs are adapted to release the retainer piece from the base piece when the quick-release tabs are moved towards one another.

6. The apparatus of claim 1 further comprising another quick-release tab and attached locking rib and wherein said quick-release tabs are adapted to release the retainer piece from the base piece when the quick-release tabs are moved away from one another.

7. An apparatus for mounting a pad to a rotary pad machine comprising:

a base piece having a base wall and a base flange extending radially outward from said base wall;

a plurality of base teeth on the inside of said base wall;

a retainer piece having first and second retainer walls and a retainer flange extending radially outward from said first retainer wall and said second retainer wall, said retainer walls adapted to be received in said base wall, said base teeth adapted to be received between said retainer walls such that said retainer walls prevent rotation of said base piece relative to said retainer piece when said retainer walls are received in said base wall;

a locking rib associated with said retainer piece and located between said retainer walls, said locking rib adapted to lock into said base teeth; and a quick-release tab connected to said locking rib, said quick-release tab adapted to release the retainer piece from the base piece;

said retainer piece and said base piece configured such that when said retainer walls are received in said base wall, said pad is located and held between said base flange and said retainer flange.

8. The apparatus of claim 7, further comprising means for biasing said locking rib against said base teeth.

9. The apparatus of claim 8, wherein said means for biasing comprises the quick-release tab being integrally molded with said retainer wall, and said quick-release tab comprising a resilient material.

10. The apparatus of claim 7 wherein said base teeth and said locking rib have a saw-tooth configuration.

11. The apparatus of claim 7 wherein said quick-release tab is adapted to release the retainer piece from the base piece when the quick-release tab in moved towards the center of the apparatus.

12. The apparatus of claim 7 wherein said quick-release tab is adapted to release the retainer piece from the base piece when the quick-release tab is moved towards the outside of the apparatus.

13. The apparatus of claim 7 further comprising:

a base connecting wall;

a base arcuate segment connected between said base connecting wall and said base wall;

wherein said base teeth are located on the inside of said base arcuate segment; and a retainer connecting piece attached to one of said retainer walls, said retainer connecting piece adapted to be received on the outside of said base connecting wall when said retainer piece is connected to said base piece whereby the rotation of said base piece relative to said retainer piece is prevented.

14. The apparatus of claim 13, wherein said quick-release tab is connected between said retainer connecting piece.

15. An apparatus for mounting a pad to a rotary pad machine comprising:

a base piece having a base wall and a base flange, said base flange radially extending from said base wall;

said base wall including a plurality of base arcuate segments and a plurality of connecting walls;

said base arcuate segments having a plurality of base teeth, said base teeth having a sawtooth profile;

a retainer piece having a plurality of retainer walls ending in retainer wall edges, said retainer walls adapted to be received within said base wall, and a retainer flange extending radially from said retainer walls;

a plurality of retainer connecting pieces connected to said retainer wall edges;

a plurality of quick-release tabs attached to said retainer connecting pieces; and a plurality of locking ribs on the outside of said quick-release tabs adapted to engage said base teeth when said retainer walls are received within said base wall;

said retainer piece and said base piece configured such that when said retainer walls are received in said base wall, said pad is located and held between said base flange and said retainer flange.

* * * * *

UNITED STATES PATENT AND TRADEMARK OFFICE

CERTIFICATE OF CORRECTION

PATENT NO. : 5,619,770

DATED : April 15, 1997

INVENTOR(S) : W.E. Bell

It is certified that error appears in the above-indentified patent and that said Letters Patent is hereby corrected as shown below:

| COLUMN | LINE | |
|---|---|---|
| On the title page: | | |
| [56] | Refs. Cited (U.S. Pat. Docs., Item 1) | "3,135,981 6/1964" should read --3,135,981 6/1954-- |
| 10 (Claim 9, | 9 line 3) | "wall," should read --walls,-- |

Signed and Sealed this

Twenty-third Day of September, 1997

*Attest:*

BRUCE LEHMAN

*Attesting Officer*

*Commissioner of Patents and Trademarks*